United States Patent [19]

Whiting

[11] 4,213,237

[45] Jul. 22, 1980

[54] STABBING GUIDE

[76] Inventor: Winslow Whiting, 10030 Briar Forest, Houston, Tex. 77018

[21] Appl. No.: 945,987

[22] Filed: Sep. 25, 1978

[51] Int. Cl.[2] ..... B25B 27/14

[52] U.S. Cl. ..... 29/272

[58] Field of Search ..... 29/271, 272, 270; 81/417, 425 R; 269/238, 254 CS, 268; 175/220; 166/77.5, 85

[56] References Cited

U.S. PATENT DOCUMENTS

| | | | |
|---|---|---|---|
| 699,803 | 5/1902 | Monehan et al. | 81/425 R |
| 1,065,387 | 6/1913 | Ogg | 29/272 |
| 2,530,788 | 11/1950 | Scott | 29/272 |
| 2,815,777 | 12/1957 | Iraids | 269/268 |
| 3,287,042 | 11/1966 | Baer | 269/238 |

*Primary Examiner*—James L. Jones, Jr.

*Attorney, Agent, or Firm*—Murray Robinson; Ned L. Conley; David Alan Rose

[57] ABSTRACT

A stabbing guide tool of facilitate makeup of pipe connections comprises a diametrally split, hinged, rigid plastics material infundibulum of high lubricity toughness, and strength adapted to receive and guide a pin connector and having a locating socket adapted to engage a box connector. The tool is spring loaded to closed position by a torsion spring and provided with a pair of hand grip levers to facilitate opening, placement, and removal.

5 Claims, 2 Drawing Figures

STABBING GUIDE

BACKGROUND OF THE INVENTION

This invention relates to hand tools and more particularly to a stabbing guide for facilitating makeup of pipe connections, especially in connection with the completion of petroleum wells.

Two types of guides are described on page 35 of the 1977 Edition of the Hydril catalogue entitled "Tubular Connections". One form is a rubber funnel split on one side and provided with a latch and handles. For larger size pipe a similar construction is made of aluminum, with the side opposite the split hinged. Difficulties with such known guides arise from the fact that rubber tears and aluminum bends. Merely increasing the aluminum strength by hardening is not a solution to the problem since hardened aluminum chips.

SUMMARY OF THE INVENTION

In an effort to overcome the problem of the known guides, applicant chose a rigid plastics material. Such material provides not only resistance to tearing and chipping and bending but has the additional advantage of being inert in salt water, mud, oil, and thread dope, which are materials frequently encountered around a petroleum well. Unexpectedly, a further advantage appears in that a plastics material can be chosen which has a high lubricity, thereby enhancing the guiding action of the tool. The material will have a hardness greater than that of rubber, but less than that of steel, thereby to prevent damage both to the tool and to the threads of the pin connector.

A further improvement is the elimination of the latch used in the aforementioned prior constructions. The tool, an infundibulum diametrally split and hinged at one side, is biased to closed position by a powerful torsion spring concentrically disposed around the hinge pintle. To enable the tool to be opened, it is provided with two levers, one on each half, positioned to be gripped in the hand so that closure of the hand on the grips opens the tool at the opposite side. The levers also provide convenient handle means which can be gripped with one hand, as distinct from the prior construction having two separate handles requiring preferably both hands of the operator.

The levers are attached to the two halves o the infundibulum by arcuate plates extending nearly all the way about the girth of the tool. The levers and plates, made of light metal such as aluminum, give added strength to the infundibulum. The metal plates fit in an annular recess about the girth of the tool whereby the tough plastics material protects the aluminum against chipping and bending under the impact of banging by heavy pipe.

A suitable plastics material is a composite made of oriented tetrafluoroethylene (TFE) fibers uniformly dispersed in acetyl resin, known to the trade as Dupont "Delrin". Delrin has a high modulus of elasticity, high sittness, high strenth, low coefficient of friction, good abrasion and impact resistance, low moisture absorption, and excellent machinablity. It is beleived that the TFE fibers give Delrin a higher surface lubricity unmodified acetyle while retaining acetyl's strength, toughness, and dimensional stability. Other plastics material having similar properties may be employed and may be hereinafter referred to as TFE modified acetyle type plastics material.

BRIEF DESCRIPTION OF DRAWINGS

For a more detailed description of the invention reference will now be made to the accompanying drawings wherein.

DESCRIPTION OF PREFERRED EMBODIMENT

Figure 1:
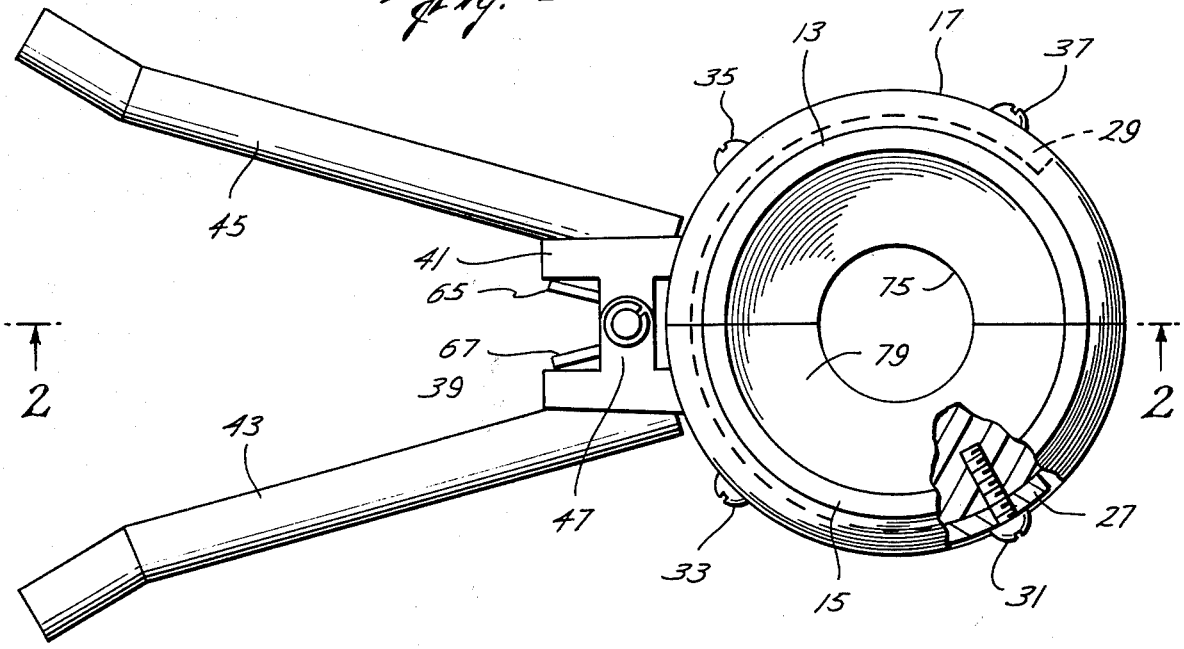
FIG. 1 is a top view of a tool embodying the invention, partly in section.
Figure 2:
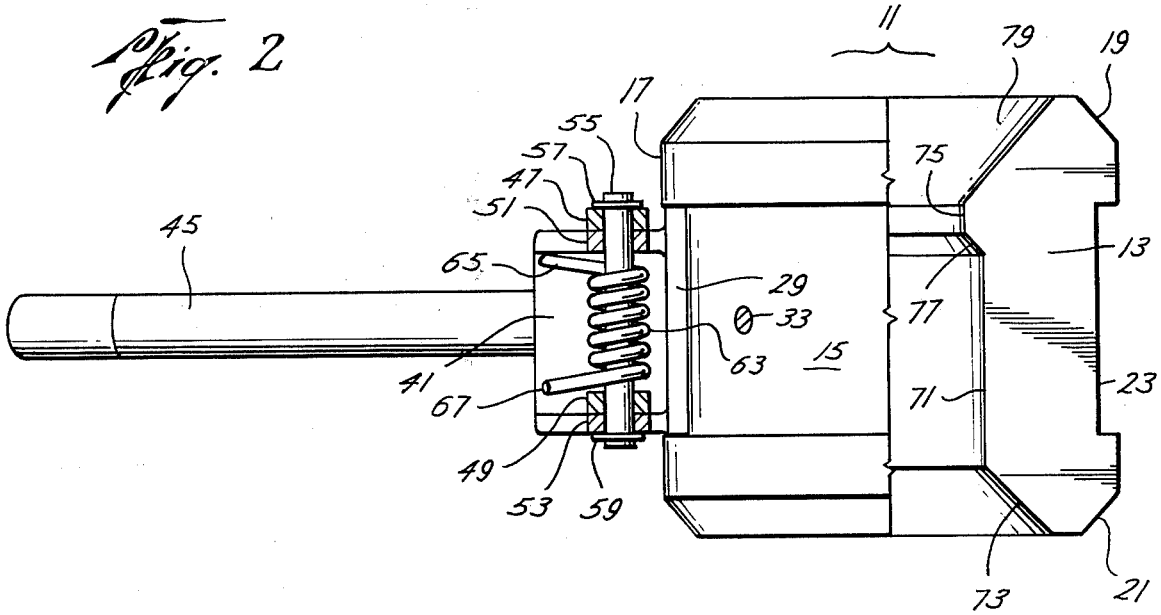
FIG. 2 is a side view, partly in section at plane 2—2 of FIG. 1.

Referring now to the drawings, there is shown a stabbing guide comprising a TFE modified acetyl plastics material infundibulum 11 split diametrally into two halves 13, 15. The infundibulum has a generally cylindrical outer periphery 17 with annular bevels 19, 21 at its upper and lower outer peripheries. There is an annular groove about the outer periphery of the infundibulum forming a waist 23.

Received in waist 23 are arcuate aluminum plates 25, 27 which are secured to the waist by steel screws 31, 33, 35, 37. Each of plates 27, 29 extends over about 120° of the waist of the infundibulum. The plates abut each other at one juncture of the two halves 13, 15 of the infundibulum where they are hinged together. Each half 13, 15 is provided with a radially extending aluminum flange 39, 41. Secured to the flanges are aluminum handles 43, 45.

Flange 39 is provided with upper and lower transverse, apertured, aluminum ears 47, 49; flange 41 is provided with upper and lower transverse, apertured, aluminum ears 51, 53 just below ears 47, 49. A steel, hinge pin 55 extends through the apertures in the ears and is held in position by steel V clips 57, 59 received in annular grooves in the ends of the pin. If desired, steel washers can be disposed between each clip and the adjacent ear. There is thus formed means hinging together the two halves of the infundibulum.

A steel helical torsion spring 63 concentric with pin 55 has its ends 65, 67 bearing against plates 41, 39. By this spring means the two halves of the infundibulum are strongly biased together to closed position. However, due to the length of handles 43, 45, a person can easily open the infundibulum to remove it from position in which a tubing joint extends therethrough.

The infundibulum has a generally cylindrical inner periphery 71 adapted to receive a tubing connector box. An annular bevel 73 about the lower inner edge of the infundibulum provides means to guide the infundibulum into position about such a box. An internal annular flange 75 on the inner periphery of the infundibulum provides a downwardly facing shoulder 77 which limits downward travel of the infundibulum on the box.

The upper inner periphery 79 of the infundibulum provides a guide to facilitate stabbing a tubing connector pin into the tubing connector box through flange 75.

From the foregoing description it will be seen that there has been provided a light weight tool eminently suited for its function as a stabbing guide. The high lubricity of the infundibulum facilitates both the placement of the tool over a connector box and stabbing a connector pin through the guide into the box without damage to the pin, the box, or the tool. The spring hinge holds the guide in place while in use, and the handles make it easy to open the infundibulum to remove the tool from the madeup tubing connection.

While a preferred embodiment of the tool has been shown and described, modifications thereof can be made by one skilled in the art without departing from the spirit of the invention.

I claim:

1. A stabbing guide tool for facilitating makeup of threaded pin and box tubing connectors comprising an infundibulum made of lubricous plastics material having a hardness greater than that of elastomer rubber (above 90 Shore A scale) and less than that of steel, said infundibulum being split diametrally into two parts with hinge means at one end of the split, torsion spring means biasing the two parts together into closed position, a pair of arcuate aluminum plates each extending about said infundibulum on opposite sides thereof from adjacent said hinge means over half way toward the other end of the split, screws means securing the plates to the infundibulum, and a handle extending generally radially from each plate adjacent the hinge, the handles diverging to a hand grip spacing, whereby upon pressing the handles together with the hand the infundibulum is opened.

2. Tool according to claim 1, said infundibulum having a cylindrical socket at its inner periphery adapted to fit about a tubing connector box, an annular flange extending radially inwardly from the inner periphery of the infundibulum above and concentric with the socket providing a downwardly facing shoulder to limit downward motion of the socket over a connector box, and a downwardly conical surface at the upper end of the inner periphery of the infundibulum above said flange and concentric therewith, the angle between said handles in the closed position of the infundibulum being at least equal to the angle between the diametral faces of the infundibulum when the space between the ends of the split opposite said hinge means is equal to the diameter of said socket, whereby upon movement of said handles into adjacency, the infundibulum will open sufficiently to allow it to be moved away from such connector box in a direction trnasverse to the axis of the box and infundibulum socket.

3. A Stabbing guide tool for facilitating makeup of threaded pin and box tubing connectors comprising:

an infundibulum made of lubricous plastics material, said infundibulum being split diametrally into two parts with hinge means at one end of the split, spring means biasing the two parts together into closed position, and handles secured to the two parts, said handles being separated when the infundibulum is closed, said parts of the infundibulum being separated to an open position when said handles are pressed together against the action of said spring means, arcuate metal plates secured to the outer periphery of said infundibulum, said handles being secured to said metal plates, said metal plates being disposed in an annular groove around the outer periphery of the infundibulum, the outer upper and lower edges of said infundibulum being beveled, said infundibulum having a cylindrical socket in the lower end thereof, the mouth of the socket being beveled and the end of the socket opposite said mouth being provided with stop means to prevent passing of a box clear through the socket, and a conical guide at the upper end of the infundibulum, said plates and handles being made of aluminum and said infundibulum being made of TFE fibre modified actyl plastics material, said metal plates each having a radial flange to which one of said handles is connected, each flange having a pair of transverse apertured ears, said ears of one pair being adjacent the ears of the other pair, a pin extending through said aperture means securing said pin against axial motion relative to said ears, and a helical torsion spring around the said pin having its ends bearing against said flanges.

4. A stabbing guide tool for facilitating makeup of threaded pin and box tubing connectors comprising an infundibulum split diametrically into two parts with hinge means at one end of the split, said infundibulum having a cylindrical socket at its inner periphery adapted to fit about a tubing connector box, an annular flange extending radially inwardly from the inner periphery of the infundibulum above and concentric with the socket providing a downwardly facing shoulder to limit downward motion of the socket over a connector box, and a downwardly conical surface at the upper end of the inner periphery of the infundibulum above said flange and concentric therewith, said tool being characterized by including:

(1) spring means biasing said two parts of the infundibulum for rotation about said hinge means to a closed position in which the diametral faces of the split infundibulum are adjacent and said socket may be slid telescopically over said box, and (2) handles secured to said two parts and projecting therefrom transversely to the infundibulum axis, there being space between the ends of the split opposite said hinge means when said handles are pressed together to open the infundibulum, (3) there being an angle between said handles in the closed position of the infundibulum at least equal to the angle between the diametral faces of the infundibulum when the space between the ends of the split opposite said hinge means is equal to the diameter of said socket, whereby upon movement of said handles into adjacency, the infundibulum will open sufficiently to allow it to be moved away from such connector box in a direction transverse the axis of the box and infundibulum socket.

5. Tool according to claim 4 wherein said infundibulum is made of lubricous plastics material having a hardness greater than that of elastomer rubber (above 90 Shore A scale) and less than that of steel, said tool including arcuate metal plates secured to the outer periphery of said infundibulum, said handles being secured to said metal plates, said socket having a guide bevel at its lower end opposite from said conical surface and concentric therewith.

* * * * *

UNITED STATES PATENT AND TRADEMARK OFFICE

CERTIFICATE OF CORRECTION

PATENT NO. : 4,213,237

DATED : July 22, 1980

INVENTOR(S) : Winslow Whiting

It is certified that error appears in the above—identified patent and that said Letters Patent is hereby corrected as shown below:

Abstract, line 1, change "of"
Col. 3, line 17, change "screws" to -screw-.
Col. 3, line 42, change "Stabbing" to -stabbing-.

Abstract, line 3, after "lubricity" insert a comma (,).
Col. 1, line 60, change "sittness" to -stiffness-.
Col. 1, line 62, change "beleived" to -believed-.
Col. 1, line 63, after "lubricity" insert -than-.
Col. 1, line 64, change="acetyle" to -acetyl-.
Col. 1, line 67, change "acetyle" to -acetyl-.
Col. 2, line 32, after "steel", delete the comma (,).

UNITED STATES PATENT AND TRADEMARK OFFICE

CERTIFICATE OF CORRECTION

PATENT NO. : 4,213,237

DATED : July 22, 1980

INVENTOR(S) : Winslow Whiting

It is certified that error appears in the above—identified patent and that said Letters Patent is hereby corrected as shown below:

Col. 3, line 5, after "comprising" insert a colon (:)
Col. 3, line 40, change "trnasverse" to -transverse-.

Signed and Sealed this

*Nineteenth* Day of *May 1981*

[SEAL]

*Attest:*

RENE D. TEGTMEYER

*Attesting Officer*

*Acting Commissioner of Patents and Trademarks*